US005322272A

United States Patent [19]

Benz et al.

[11] Patent Number: 5,322,272

[45] Date of Patent: Jun. 21, 1994

[54] SHEET DELIVERY DEVICE FOR CONTINUOUSLY RECEIVING SHEETS DURING STACK REMOVAL

[75] Inventors: Martin Benz, Eislingen; Hermann J. Falkenstein, Goppingen; Rudolf Liepert, Augsburg, all of Fed. Rep. of Germany

[73] Assignee: MAN Roland Druckmaschinen AG, Fed. Rep. of Germany

[21] Appl. No.: 947,717

[22] Filed: Sep. 18, 1992

[30] Foreign Application Priority Data

Sep. 18, 1991 [DE] Fed. Rep. of Germany ..... 4131015

[51] Int. Cl.[5] ..... B65H 31/12

[52] U.S. Cl. ..... 271/218; 271/211; 414/790.8

[58] Field of Search ..... 271/189, 209, 211, 213, 271/215, 218, 217, 223; 414/789.9, 790.8, 791

[56] References Cited

U.S. PATENT DOCUMENTS

| | | | |
|---|---|---|---|
| 4,162,649 | 7/1979 | Thornton | 271/218 X |
| 4,357,218 | 11/1982 | Karis | 271/218 X |
| 4,796,879 | 1/1989 | Martini et al. | 271/218 |
| 4,799,847 | 1/1989 | Bodewein | 271/211 X |
| 4,878,659 | 11/1989 | Besemann | 271/218 |
| 5,002,456 | 3/1991 | Gösslinghoff | 271/218 X |
| 5,131,647 | 7/1992 | Henn et al. | 271/218 X |

FOREIGN PATENT DOCUMENTS

| | | | |
|---|---|---|---|
| 921154 | 12/1954 | Fed. Rep. of Germany . | |
| 1231721 | 1/1967 | Fed. Rep. of Germany . | |
| 2315813 | 1/1975 | Fed. Rep. of Germany . | |
| 7509635 | 11/1976 | Fed. Rep. of Germany | 271/218 |
| 2751489 | 2/1979 | Fed. Rep. of Germany . | |
| 2736832 | 3/1979 | Fed. Rep. of Germany . | |
| 2935710 | 3/1980 | Fed. Rep. of Germany . | |
| 3535113 | 4/1987 | Fed. Rep. of Germany . | |
| 3937944 | 4/1991 | Fed. Rep. of Germany . | |
| 4001565 | 7/1991 | Fed. Rep. of Germany . | |
| 1060191 | 3/1967 | United Kingdom | 271/211 |

*Primary Examiner*—Robert P. Olszewski
*Assistant Examiner*—Boris Milef
*Attorney, Agent, or Firm*—Leydig, Voit & Mayer, Ltd.

[57] ABSTRACT

A sheet delivery device is provided that allows for high output and accurate operation during changing of the main stack. The device includes two secondary stack carriers which are normally disposed on opposite sides of the main stack in a first lateral waiting position. The secondary stack carriers are reciprocally moveable between the first lateral waiting position and an operative position. In the operative position, the secondary stack carriers accumulate a secondary stack while the main stack is being changed. This secondary stack is later deposited on the new main stack. Cooperating with the secondary stack carriers are separating elements normally disposed above the secondary stack carriers in a second lateral waiting position. The separating elements are reciprocally moveable between the second lateral waiting position and a separating position. In the separating position, the elements accumulate a temporary stack to form an entry gap above the main stack. The secondary stack carriers, which are plate-like enter this entry gap to arrive at the operating position. The separating elements thereafter deposit the temporary stack on the secondary stack carriers to form the secondary stack.

23 Claims, 4 Drawing Sheets

SHEET DELIVERY DEVICE FOR CONTINUOUSLY RECEIVING SHEETS DURING STACK REMOVAL

BACKGROUND OF THE INVENTION

1. Field of the Invention

The present invention relates generally to a sheet delivery device for sheet-fed machines, and more particularly concerns a sheet stacking device for use in printing presses.

2. Description of the Prior Art

Various types of sheet delivery devices are known in the art. Generally, these include a stack-receiving tray or pallet for receiving a stack of sheets. The stack-receiving pallet is lowered until the stack reaches a predetermined height. The stack-receiving pallet is then removed, and an empty one substituted. To avoid having to stop sheet-feeding during this change, a secondary stack-receiving device is generally provided. This secondary stack-receiving device accumulates sheets until the new stack-receiving pallet is in place, whereupon these sheets are deposited on the stack and normal operation continues. An arrangement of this kind is known from DE-PS 1 231721 wherein the secondary stack-receiving device is in the form of a roller shutter which is unwindable from a winding shaft disposed near the back of the delivery mechanism and whose side edges run in stationary horizontal guides. The roller shutter has a relatively large mass and, therefore, can move only comparatively slowly. Consequently, the output rate of the sheet-fed machine has to be reduced upon activation of the secondary stack-receiving device. However, it is inevitable that a number of sheets arrive before termination of the entry operation of the roller shutter so that there are bound to be relative movements between the shutter and the bottom sheet and, therefore, relative movement between the sheets above the bottom sheet, with the risk of damage to the sheets and the freshly printed image. This disadvantage is further heightened in the known arrangement because the roller shutter is required to bridge substantially the whole length of the stack, so that the required entry time is quite long. Another disadvantage of the known arrangement is that when the shutter withdraws, the secondary stack thereon may be skewed because of friction. Also, the shutter is in the form of a bulky coil when wound and may hinder access to the delivery mechanism from the front thereof.

Objects and Summary of the Invention

It is therefore the primary aim of the present invention to provide a sheet delivery device which can provide a high output during stack changing while still ensuring accurate and troublefree operation.

According to the invention, the sheet delivery device includes means for receiving the main stack that is removed and replaced along with the main stack. Also included is a main stack elevator that controls the position of the main stack receiving means according to timing signals, the timing signals being provided by a level switch. The sheet delivery device further includes a non-stop means for allowing continuous feeding of sheets when the main stack is being changed. The non-stop means accumulate a secondary stack during stack changing, and this secondary stack is thereafter deposited on the main stack-receiving means containing the new main stack.

Pursuant to one aspect of the invention, the nonstop means includes two secondary stack carriers which are each normally disposed on opposite sides of the main stack in a first lateral waiting position. The secondary stack carriers are reciprocally moveable between the first lateral waiting position and an operative position over the main stack-receiving means. When the secondary stack carriers are in the operative position, sheets are accumulated to form the secondary stack on the secondary stack carriers. The non-stop means further includes separating elements normally disposed above each of the secondary stack carriers in a second lateral waiting position. The separating elements are reciprocally moveable between the second lateral waiting position and a separating position in which they accumulate a temporary stack to create an entry gap between the temporary stack and the main stack. This entry gap allows for movement of the secondary stack carriers to the operative position. The separating elements are adapted to thereafter deposit the temporary stack on the secondary stack carriers which are in the operative position. Thus, the secondary stack is formed on the secondary stack carriers when the separating elements are moved to the second lateral waiting position.

In a preferred embodiment, the separating elements take the form of relatively light pins or the like and can move rapidly because of their reduced weight. The separating elements can therefore be "shot in" at high speed during the passage of a gap between two sheets. Relative movement between the entering separating elements and the sheet material to be received thereon is, therefore, precluded. As a result, there is no need to reduce output. Consequently, the secondary stack carriers introducible into the entry gap, kept open by the separating elements, can move relatively slowly, with the further advantage that stressing of the associated motion equipment and noise are reduced. Because each of the two reciprocally movable secondary stack carriers has to travel only half the distance under the stack, movement times are comparatively short. Also, because the secondary stack carriers move in opposite directions, the thrust forces they produce cancel one another out in an advantageous manner so that there is essentially no risk of the secondary stack shifting. Furthermore, because the secondary stack carriers are disposed laterally of the main stack there is an appreciable saving of space.

In the preferred embodiment, the secondary stack carriers are disposed for displacement on a lifting frame guided vertically by means of a vertical guide and suspended on a secondary stack elevator which, with the secondary stack carriers in the inserted position, is lowerable in timed fashion by means of the level switch. This feature ensures that the increase in secondary stack height can be compensated for by timed lowering, so that the arriving sheets are always presented with the same deposition level, resulting in greater stacking accuracy and freedom from malfunctioning.

According to another aspect of the preferred embodiment, the lifting frame has longitudinal guides for a slide receiving a secondary stack carrier, the slides being synchronized by synchronizing means preferably in the form of a cable control. Synchronizing the two oppositely movable secondary stack carriers ensures that forces tending to displace the secondary stack on the carriers cancel one another out right from the start, thereby increasing the level of accuracy obtainable.

Preferably, the secondary stack carriers are in the form of plate-like swords, tapered panels or the like. The swords or panels are arcuately contoured and have tapered wedge-like shapes in their facing edge zones. These features not only facilitate reliable reception of the secondary stack but also and advantageously ensure that when they enter the associated gap, the secondary stack carriers can open up a path without causing damage, so that even if the entry gap is not ideal, a high level of operating reliability and careful handling of the sheets are ensured. Also, the features have the advantage of providing, in a simple manner, the production of an air cushion, which further helps to ensure operation which avoids damage to the sheets.

In a particularly preferred embodiment, the secondary stack carrier swords or panels can take the form of sandwich panels, whose interior is subdivided by webs and is connected to a source of compressed air which exits from the top panel through blowing nozzles, preferably in the form of ball valves.

In a further development according to the preferred embodiment, the separating elements on each side can be received in a slide adjustably received on a horizontal guide rigidly secured to the frame. Consequently, the separating elements are not lowered together with the lifting frame, a feature which helps to simplify construction. Additionally, the separating elements are pivotable and can be lowered at their front end from a horizontal insertion position by associated pivoting means. The separating elements, when thus lowered, extend in a manner adapted to the sheets, whose side edges are received on such elements such that the sheets sag in the center as far as the main stack. This ensures that a reliable entry gap for the sword-like or plate-like secondary stack carriers is created.

According to another feature of the preferred embodiment, the displacing means associated with the separating elements are actuated by means of a sensor providing direct or indirect sensing of each arriving sheet, thus reliably obviating collisions. Desirably, vibratable side joggers are also provided near the vertically stationary separating elements. This further helps to improve stacking accuracy.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to these specific embodiments. Rather it is intended to cover all such alternative embodiments and modifications as they fall within the spirit and scope of the invention.

Detailed Description of the Preferred Embodiment

Figure 1:
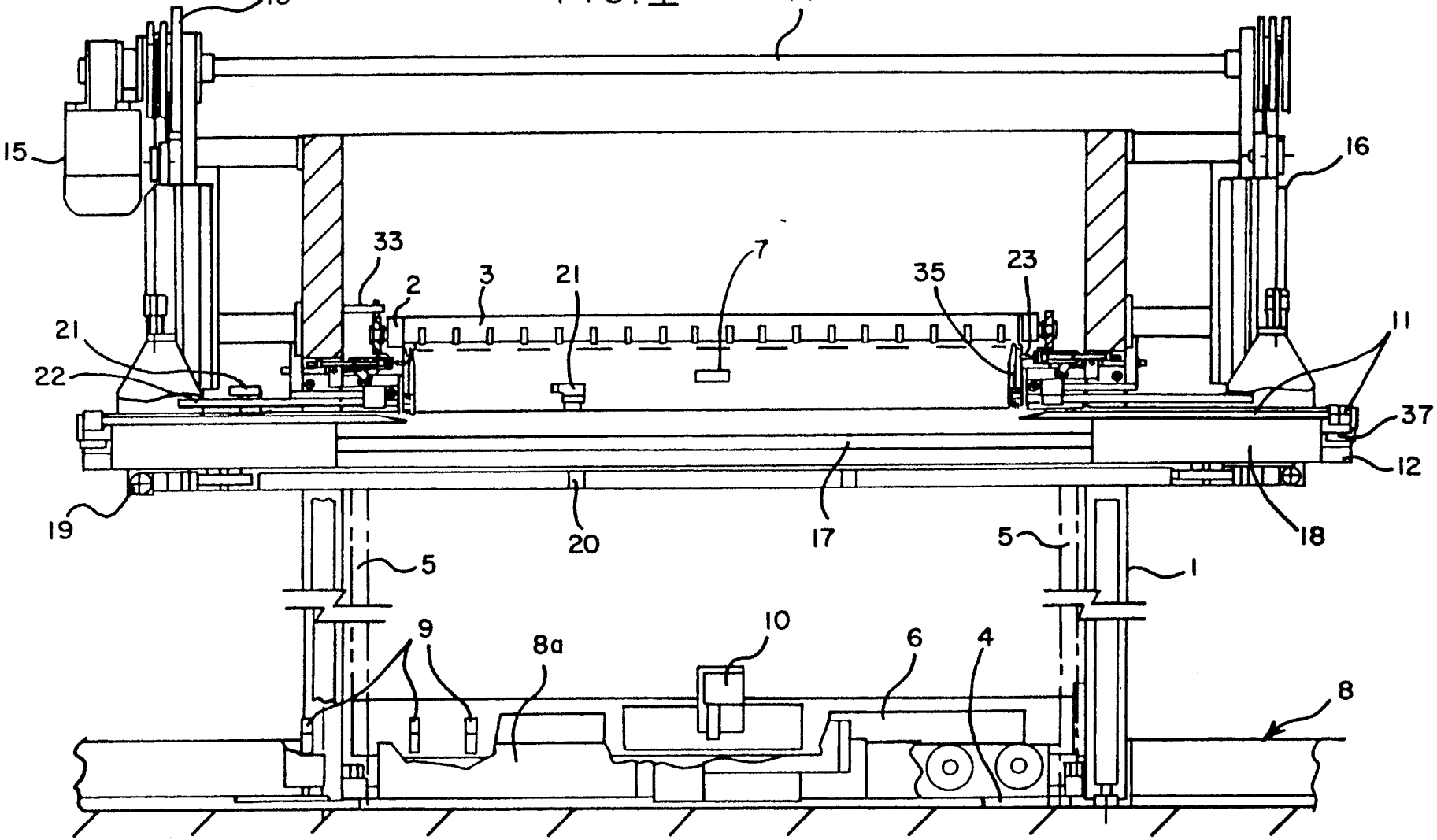
FIG. 1 is a front elevation view, partly in section, of the sheet delivery device according to the present invention.

FIG. 1 shows the sheet delivery device according to the present invention. Sheets printed in a sheet printing press are delivered in the form of a stack by means of a delivery device disposed after the press. The delivery device shown in FIGS. 1 and 2 comprises a gantry frame 1 into which a sheet transport device enters, the sheet transport device having gripper bars 3 disposed on side chains 2. The sheet transport device discharges the sheets retained by the gripper bar grippers 3 on to stack-receiving means disposed in the frame 1. In the present case, main stack receiving means and secondary stack receiving means which are used alternately are provided, in order to achieve non-stop operation.

The main stack receiving means comprises a vertically movable platform 4 movable by means of an associated main stack elevator indicated here by its chains 5 driven by a motor not shown in greater detail. The platform 4 is adapted to be loaded with a pallet 6 for receiving a stack of sheets. The main stack elevator motor (not shown) can be controlled by a level switch 7 in the form, for example, of a capacitative sensing head, so that the top edge of the stack received on the pallet 6 is always at a constant level. The platform 4 is lowered to floor level for loading and unloading. For the lateral exit of a pallet with a stack or for the lateral introduction of a new empty pallet, a conveyor in the form of a roller train 8 extending transversely of the sheet delivery direction is provided and the conveyor drive elements can be controlled by sensors in the form of light barriers 9. The conveyor 8 comprises a central part 8*a* mounted on platform 4 and flanked by preceding and subsequent parts for supplying a new pallet or removing a loaded pallet, respectively. Drive means 10 in the form of a piston and cylinder unit are provided to shift a pallet which has entered the central conveyor part 8*a*, the same being rigidly secured to the sheet delivery device.

Figure 4:
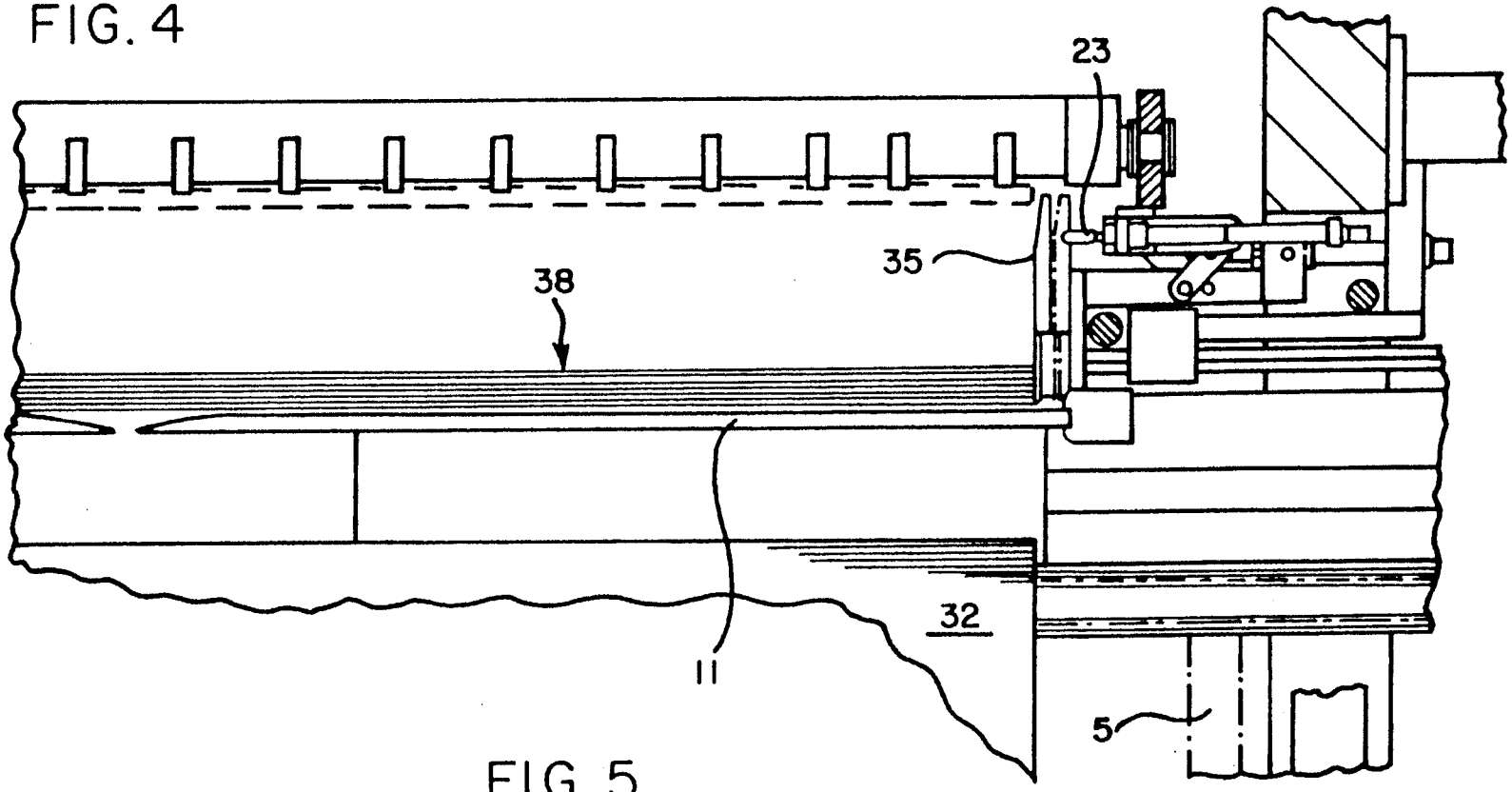
FIG. 4 is a fragmentary side view on an enlarged scale of the secondary stack carriers in their operative position.

As previously stated, the function of the non-stop means, particularly the secondary stack receiving means is to facilitate non-stop operation during stack changing —i.e., during the removal of a pallet loaded with a complete stack and the supply of the next empty pallet. The sheets arriving during stack changing are received on the secondary stack receiving means in the form of a secondary stack which can subsequently be deposited on the empty pallet which has in the meantime been moved into position on the main stack receiving means. Here the secondary stack receiving means comprises two secondary stack carriers 11 which can enter and exit laterally to opposite sides of the sheet delivery device and which can be moved from a first lateral waiting position, shown in FIGS. 1 and 2 on opposite sides of the base area of the stack, into an operative position which is shown in FIG. 4 and in which the secondary stack carriers 11 engage over the base area of the stack.

To ensure that the top edge of the secondary stack remains at a constant level the two carriers 11 and the platform 4 are lowerable in timed fashion. To this end, a lifting frame 12 is provided which receives the two carriers 11 and is guided in the lifting direction by a vertical guide and which is activatable by means of an associated secondary stack elevator 13. In the case shown here the secondary stack elevator 13 comprises a shaft 14 which bridges the delivery device, is drivable by means of an associated geared motor 15 and can be elongated or shortened by means of lifting elements 16 receiving the lifting frame 12. The timing of the motor 15 when the carriers are entered can be controlled in the same way as the timing of the motor of the main stack receiving platform by means of the level switch 7.

Figure 2:
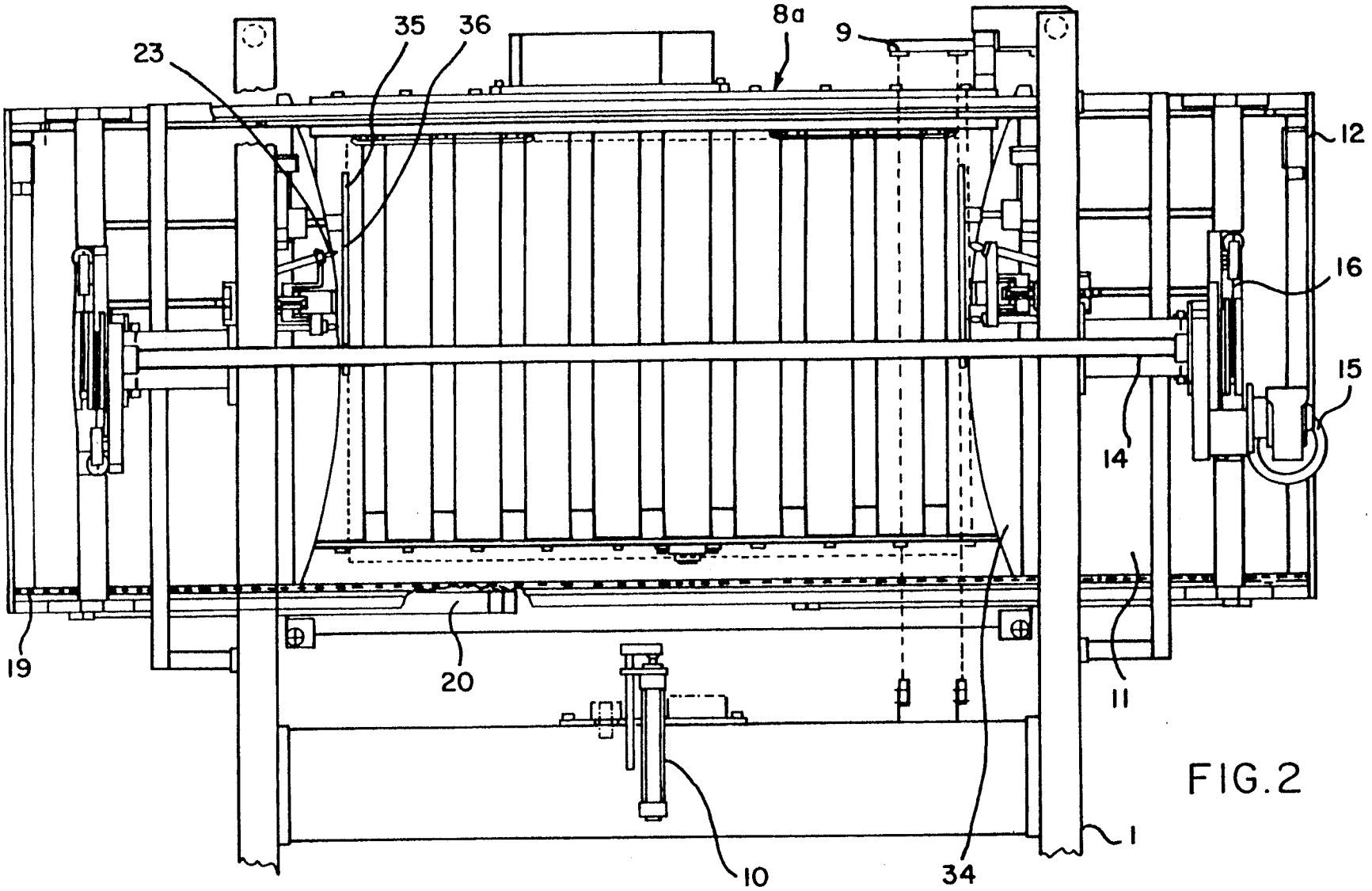
FIG. 2 is a plan view of the sheet delivery device shown in FIG. 1.

As will be most clearly apparent from FIG. 2, the lifting frame 12 is a closed rectangular frame providing good stability and torsional rigidity. Adjacent the frame members which extend transversely to the direction of sheet conveyance, the lifting frame 12 has longitudinal guides 17 on each of which a slide 18 receiving a secondary stack carrier 11 is guided for horizontal movement. (See FIG. 1) The internal width of the lifting frame 12 in the direction of sheet conveyance is greater than the maximum format length of the sheets to be dealt with. The internal width transversely thereof corresponds at least to the maximum format width of the sheets plus a distance sufficient to allow passage of sheets having the maximum format width past the secondary stack carriers 11 when they are in the first lateral waiting position. That is, this internal transverse width corresponds to the maximum format width plus the maximum depth of entry of the secondary stack carriers 11 in the operative position. Consequently, a free space corresponding to at least the maximum base area of the stack is present and so collisions are reliably avoided.

The slides 18 are movable synchronously in opposite directions, synchronization being provided by synchronizing means which in the present case take the form of a cable control 19. The synchronizing means can be connected to a common drive. In the embodiment shown, separate drives associated with the two slides 18 are provided in the form of piston and cylinder units 20. To terminate the entry or exit movement of the secondary stack carriers 11 an inner limit switch 21 and an outer limit switch 21 are provided and co-operate with a cam 22 on one of the slides 18. (See FIG. 1) The limit switches 21 control the drives associated with the two synchronously moving slides 18. The inner end switch 21 can be stationary since the two secondary stack carriers 11 always enter so far that, as FIG. 4 shows, their adjacent edges are disposed near and opposite one another. The outer limit switch 21 can be adjustable so that the exit end position can be adapted to the particular format width being dealt with.

Figure 3:
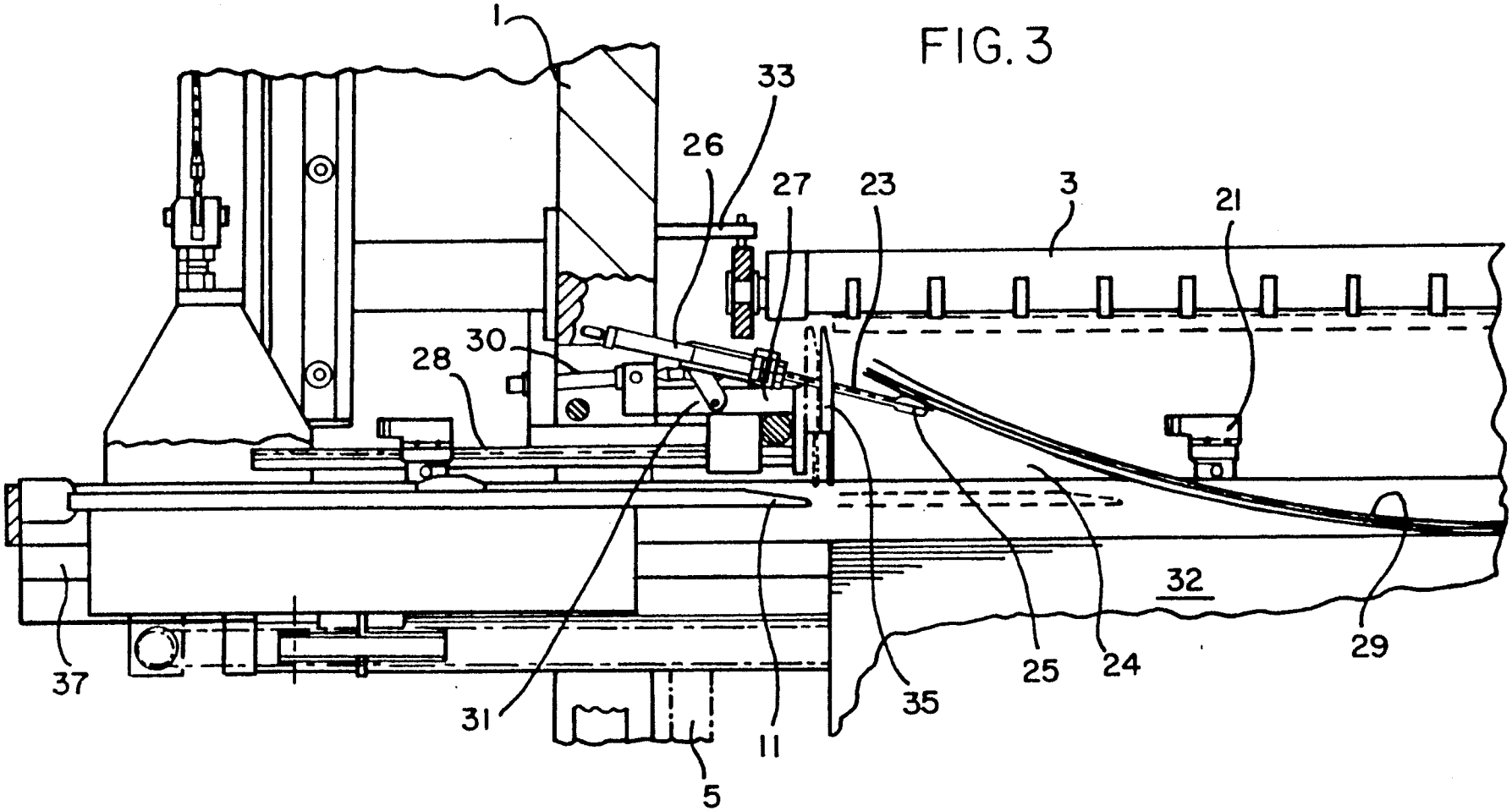
FIG. 3 is a fragmentary side view on an enlarged scale of the separating elements when in their entered position.

As can best be appreciated from FIG. 3, separating elements 23 associated with the secondary stack carriers 11 are disposed thereabove and, at the start of stack changing, are effective to keep open an entry gap 24 for the associated secondary stack carrier 11—i.e., they are effective to serve as separating aids. The separating elements 23 can be simple pins which in this case have at their front end a generally rounded or drop-like part 25. The separating elements 23 are movable axially by means of an associated displacing means which in the case shown takes the form of piston and cylinder units 26. The separating elements 23 can simply be prolonged extensions of the piston rod. Since they are of reduced weight the separating elements 23 can be moved in and out rapidly by means of the associated units 26. In the preferred embodiment, an as shown in FIG. 2, two separating elements 23 are provided near each side of the stack and are arranged in a V-fashion, such that they forwardly diverge relatively to one another. The separating elements 23 of each side are received on an associated slide 27 guided on an associated horizontal guide 28 to the press frame 1. The slides 27 can be moved manually or by motor means. Desirably, the slides 27 are so adjusted that the separating elements 23, when in their withdrawn waiting position shown in FIGS. 1 and 2, have their front end outside the base plan of the stack and, when in their introduced operative position shown in FIG. 3, have their front end extending over the associated side edge of the stack.

As FIG. 1 shows, the separating elements 23 extend substantially horizontally when in the second lateral waiting position. In the operative position shown in FIG. 3 the separating elements 23 have their front end inclined downwardly and thus extend substantially in a manner adapted to the passage of the sheets 29 whose edges they support. To this end, the separating elements 23 are mounted pivotally on the associated slide 27. In the illustrated embodiment, each slide has a pivoting means in the form of a pivoting frame 31 which is pivotable by means of an associated pivoting drive 30, the same also being a piston and cylinder unit, and on which the associated separating elements 23 and the drive elements associated with the separating elements 23 are received. If desired, the pivoting movement of the frames 31 can be limited by abutments.

In response to an instruction to change the stack, given when the stack 32 on the main stack receiving means has reached a predetermined height detectable by means of an appropriate sensor, the separating elements 23 first move from the second lateral waiting position of FIGS. 1 and 2 into the separating position of FIG. 3. This step can proceed rapidly since the elements 23 are of reduced weight so that it is possible to effect rapid insertion or "shoot-in" of the separating elements 23. To ensure that entering elements 23 do not collide with an arriving sheet, the insertion or shoot-in movement is placed laterally so that the separating elements 23 shoot in during the passage of a gap between two consecutive sheets. The necessary instruction is derived from the arriving sheet itself. To this end, in the preferred embodiment and as FIG. 1 shows, a means for sending in the form of a sensor 33 is provided which co-operates with the sheet transfer device, senses the gripper bar 3 pulling the arriving sheet and operates the piston and cylinder units 26 associated with the separating elements 23 in the correct timing. Further, operation of the piston and cylinder units 30 associated with the pivoting frames 31 can be based on sequential switching. The separating elements 23 are inserted in a horizontal alignment, then lowered. The pins serving as the separating elements 23 can initially still rest on the surface of the stack 32 received on the main stack receiving means. Upon initiation of the shoot-in of the separating elements 23 the main stack receiving means descend at high speed so that the separating elements 23 rapidly disengage from the top of the stack 32 and the stack moves by way of its top edge below the level of the secondary stack carriers 11 which have moved into their top position and which are in the waiting position.

As FIG. 3 clearly shows, the temporary stack 29 arriving after the shoot-in of the separating elements 23 have their edge raised. The central zone of the temporary stack 29 can still rest on the top of the stack 32. This leads to the formation of the wedge-shaped entry gap 24 which has previously been referred to and which the secondary stack carriers 11 can enter without colliding, as indicated by chain lines in FIG. 3. The entry movement can be comparatively slow since the temporary stack 29 accruing during the entry step are kept raised by the separating elements 23 at least at their edges. Since the secondary stack carriers 11 move synchronously and in opposite directions, the displacing forces they exert cancel one another out and so there is no shifting of the temporary stack 29.

In a particularly preferred embodiment and as shown in FIG. 2, the secondary stack carriers 11 are panel-like swords which have arcuate contouring near their front edge and which narrow wedge-fashion near such contouring. To simplify production, moldings 34 can be used which contain the arcuate contouring and wedge-shaped narrowing and which are simply attached to the rear zone of the associated secondary stack carrier 11. The contouring of the front ends of the secondary stack carriers 11 ensures that the same can contrive a passage even if the entry gap 24 is not ideal without any risk of damage to the bottom sheet 29 of the group of sheets below which the secondary stack carriers 11 have moved and which are received on the separating elements 23. As FIG. 4 shows, in the entered position the adjacent ends of the two secondary stack carriers 11 are disposed opposite and near one another, thus providing reliable support over a large area of the secondary stack 38 to be placed on them.

As will also be apparent from FIG. 4, after the entry of the secondary stack carriers 11, the separating elements 23 return to the second lateral waiting position. The temporary stack 29 previously kept raised by separating elements 23 is deposited on the entered secondary stack carrier 11, as are also the subsequent sheets. There therefore arises a secondary stack 38 whose top edge, as previously stated, is maintained at a constant level by lowering of the lifting frame 12 in which the secondary stack carriers 11 are received.

In this embodiment stacking accuracy is enhanced by the slides 27 which receive the elements 23 having side joggers 35 adjustable by means of the slides 27 to the associated stack side edge. The joggers 35 can be driven so as to vibrate the secondary stack both in response to delivery of the sheets on the main stacking means and to delivery of the sheets to the secondary stacking carriers. As the embodiment of FIG. 2 also shows, the side joggers 35 are formed with through passages 36 through which the separating elements 23 can engage when in the operative position. Consequently the separating elements 23 do not need to participate in the vibratory motion of the side joggers 35.

After the entry of the secondary stack carriers 11, the main stack 32, which was initially lowered into the position of FIG. 3 in which the sheets 29 raised at their edges by the elements 23 can bear in their central zone on the top of the stack, is further lowered until the platform 4 is in its bottom position in which the various parts of the conveyor 8 register with one another so that the pallet carrying the main stack 32 can be removed from the feeder and a new empty pallet introduced thereinto. The introduced empty pallet is raised by the platform 4 to closely below the secondary stack carriers 11. As can be seen in FIGS. 1 and 3, this position is sensed by means of a sensor 37 which is disposed on the frame 12 and which in this case is in the form of a light barrier. When the empty pallet has reached the height of the sensor 37 the same switches off the lifting means associated with the platform 4, whereafter the secondary stack carriers 11 move out. This step can also be triggered by the sensor 37 through the agency of a sequential circuit arrangement, the secondary stack 38 on the secondary stack carriers 11 being deposited on the empty pallet which has been positioned below the secondary stack carriers 11. Since the secondary stack carriers 11 move synchronously in their outward movement, the resulting displacement forces cancel one another out in the outward movement.

Figure 5:
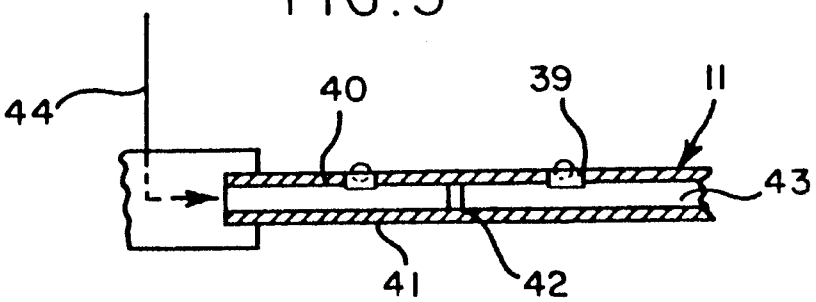
FIG. 5 is a still further enlarged partial section through a secondary stack carrier.

In accordance with another detailed aspect of the invention, an air cushion or buffer is produced to ensure very reduced friction between the secondary stack carriers 11 and the secondary stack 38 in the inward and outward movements. To this end, and as FIG. 5 shows, the secondary stack carriers 11 have near their top air-energized blowing nozzles 39. In this embodiment the nozzles take the form of ball valves which close automatically and open only when the associated ball is depressed. To simplify the supply of air to the nozzles 39 the secondary stack carriers 11 are, as will also be apparent from FIG. 5, simply in the form of sandwich panels having top and bottom cover plates 40, 41 secured to spacing webs 42. The same are disposed so that the interior 43 consists of a plurality of intercommunicating inner chambers. The interior 43 communicates by way of a line 44 with a source of compressed air and so can act as an air distributor for all the nozzles 39. The nozzles 39 can start to be supplied with air upon entry of the secondary stack carriers 11 and the supply can continue until termination of the exit step. Preferably, however, the secondary stack carriers 11 are supplied with air only during their entry or exit movement—i.e., the supply of air is activated at the start of the entry or exit operation and is stopped upon an appropriate termination. This step minimizes air consumption and also ensures that the secondary stack does not float during normal secondary stack operation.

What is claim:

1. A sheet delivery device for a sheet-fed printing press, in which sheets are delivered to a first main stack disposed on a first main stack receiving means including a removable pallet, the main stack and pallet being periodically removed and replaced by an empty pallet for receiving a new main stack when the first main stack reaches a predetermined height, the sheet delivery device comprising, in combination:

a main stack elevator for controlling the position of the main stack receiving means according to timing signals;

a level switch for providing the timing signals to the main stack elevator;

non-stop means for allowing continuous feeding of sheets when the main stack is being changed, the sheets being accumulated in a secondary stack by the non-stop means during stack changing, the secondary stack thereafter being deposited on the main stack receiving means associated with the new main stack; the non-stop means including two secondary stack carriers each normally disposed on opposite sides of the main stack in a first lateral waiting position and reciprocally movable between the first lateral waiting position and an operative position over the main stack receiving means at which sheets are accumulated to form the secondary stack on the secondary stack carriers;

the non-stop means further including a lifting frame for engaging and vertically displacing the secondary stack carriers; and a secondary stack elevator for controlling the vertical position of the lifting frame and secondary stack carriers according to timing signals provided by the level switch; and the non-stop means further comprising separating elements normally disposed above each of the secondary stack carriers in a second lateral waiting position and reciprocally movable between the second lateral waiting position and a separating position at which the separating elements accumulate a temporary stack to create an entry gap between the temporary stack and the main stack to allow for movement of the secondary stack carriers to the operative position, the separating elements being adapted to thereafter deposit the temporary stack on the secondary stack carriers in the operative position to form the secondary stack when the separating elements are moved to the second lateral waiting position.

2. A sheet-delivery device according to claim 1, including a vertical guide attached to the secondary stack elevator for guiding the lifting frame.

3. A sheet delivery device according to claim 2, wherein the lifting frame is a closed rectangular frame with an internal width at least as large as a maximum format length of the sheets, and which extends transversely beyond a maximum format width of the sheets at least by a distance sufficient to allow sheets having the maximum format width to pass the secondary stack carriers in the first lateral waiting position.

4. A sheet delivery device according to claim 3, wherein the lifting frame includes longitudinal guides, and slides movable within the longitudinal guides, the slides being adapted to receive the secondary stack carriers.

5. A sheet delivery device according to claim 2, wherein a synchronizing device synchronizes the movement of the secondary stack carriers.

6. A sheet delivery device according to claim 1, wherein the secondary stack carriers are in the form of generally planar swords.

7. A sheet delivery device according to claim 6, wherein the secondary stack carriers include facing edges, the facing edges being arcuately contoured.

8. A sheet delivery device according to claim 7, wherein the arcuately contoured facing edges of the secondary stack carriers are generally wedge-shaped.

9. A sheet delivery device according to claim 1, wherein the secondary stack carriers are generally planar and include moldings, the moldings have arcuate contouring at their facing edges and the facing edges being generally wedge-shaped.

10. A sheet delivery device according to claim 1, wherein the secondary stack carriers include air-actuated blowing nozzles.

11. A sheet delivery device according to claim 10, wherein the secondary stack carriers are in the form of sandwich panels, the sandwich panels including cover panels and at least one web connecting the cover panels, and the sandwich panels also including inner chambers bounded by the cover panels and the web, the inner chambers being in fluid communication to allow a source of compressed air to supply the blowing nozzles.

12. A sheet delivery device according to claim 11, wherein the air-actuated blowing nozzles are only actuated when the secondary stack carried are reciprocally moving between the first lateral waiting position and the operative position.

13. A sheet delivery device according to claim 1, wherein a slide is attached to the separating elements on each of the opposite sides of the main stack, and a horizontal guide is rigidly secured to a press frame on each of the opposite sides of the main stack, each slide being slidably attached to the horizontal guide to allow for horizontal movement of the separating elements attached thereto.

14. A sheet delivery device according to claim 13, wherein the separating elements have a front end and are pivotally mounted on the slide, and pivoting means are provided for pivoting the separating elements from a horizontal insertion position to a position where the front end is lower.

15. A sheet delivery device according to claim 13, wherein at least two separating elements are provided on a slide, and the at least two separating elements on a side are disposed relative to each other in a generally forwardly diverging v-shape.

16. A sheet delivery device according to claim 1, wherein the separating elements are pins, and means are provided for displacing the pins.

17. A sheet delivery device according to claim 16, wherein the displacing means are piston and cylinder units, and the pins are prolonged extensions of piston rods fixed to the pistons.

18. A sheet delivery device according to claim 16, wherein the pins have a generally rounded front end.

19. A sheet delivery device according to claim 16, including a sheet transport device and wherein sensing means are provided to actuate the displacing means, the sensing means providing direct or indirect sensing of an arriving sheet and cooperating with the sheet transport device.

20. A sheet delivery device according to claim 19, wherein the main stack receiving means is lowered to below the top of the secondary stack carriers in response to the actuation of the displacing means.

21. A sheet delivery device according to claim 1, wherein side joggers are provided near the separating elements, and the side joggers are adapted to be driven so as to vibrate the secondary stack.

22. A sheet delivery device according to claim 21, wherein slides are attached to the side joggers, and the side joggers have through passages to allow for passage of the separating elements.

23. A sheet delivery device according to claim 1, wherein the main stack receiving means includes a portion of a roller train, and means are provided for changing the stack, the stack changing means being disposed on a press floor and, including first and second roller train sections, each section extending away from the press in a direction transverse of a sheet delivery direction, the portion of the roller train being disposed between the first and second roller train sections.

* * * * *